US008870356B2

(12) United States Patent
Kim et al.

(10) Patent No.: US 8,870,356 B2
(45) Date of Patent: Oct. 28, 2014

(54) MICRO-EJECTOR

(75) Inventors: Sang Jin Kim, Gyunggi-do (KR); Changsung Sean Kim, Gyunggi-do (KR); Suk Ho Song, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 235 days.

(21) Appl. No.: 12/926,625

(22) Filed: Nov. 30, 2010

(65) Prior Publication Data

US 2011/0316939 A1 Dec. 29, 2011

(30) Foreign Application Priority Data

Jun. 28, 2010 (KR) ..... 10-2010-0061436

(51) Int. Cl.
*B41J 2/175* (2006.01)
*B41J 2/14* (2006.01)

(52) U.S. Cl.
CPC .... *B41J 2/14233* (2013.01); *B41J 2002/14362* (2013.01)
USPC ..... 347/86

(58) Field of Classification Search
None
See application file for complete search history.

(56) References Cited

U.S. PATENT DOCUMENTS

| | | | | |
|---|---|---|---|---|
| 5,622,897 | A * | 4/1997 | Hayes | 438/21 |
| 6,808,683 | B2 | 10/2004 | Gilbert | |
| 7,399,070 | B2 * | 7/2008 | Nakamura et al. | 347/84 |
| 2008/0106577 | A1 | 5/2008 | Hanaoka et al. | |

FOREIGN PATENT DOCUMENTS

| | | |
|---|---|---|
| JP | 2005-201707 | 7/2005 |
| JP | 2008-114569 | 5/2008 |
| JP | 2008-249720 | 10/2008 |
| JP | 2010-12756 | 1/2010 |
| KR | 10-2008-0098158 | 11/2008 |
| KR | 10-2010-0029423 | 3/2010 |

OTHER PUBLICATIONS

Korean Office Action mailed May 29, 2012 issued in corresponding Korean Patent Application No. Oct. 2010-0061436.
Korean Office Action issued Nov. 27, 2012 in corresponding Korean patent application No. 10-2010-0061436.

* cited by examiner

*Primary Examiner* — Matthew Luu
*Assistant Examiner* — Erica Lin

(57) ABSTRACT

There is provided a micro-ejector. The micro-ejector according to an exemplary embodiment of the present invention may include an ejection device including a passage for ejecting fluid contained therein, and a piezoelectric actuator providing a driving force for ejecting fluid, a mounting plate including a passage for providing fluid to the ejection device formed therein, and a mounting groove on which the ejection device is mounted, and a connection member formed on the mounting plate, and adopted for connecting the piezoelectric actuator to an external power source.

8 Claims, 4 Drawing Sheets

MICRO-EJECTOR

CROSS-REFERENCE TO RELATED APPLICATIONS

This application claims the priority of Korean Patent Application No. 10-2010-0061436 filed on Jun. 28, 2010, in the Korean Intellectual Property Office, the disclosure of which is incorporated herein by reference.

BACKGROUND OF THE INVENTION

1. Field of the Invention

The present invention relates to a micro-ejector, and more particularly, to a micro-ejector, in which a structure of a power line applying power to a piezoelectric element and a structure of a fluid supplying line supplying fluid to an ejection device may be simplified so as to eject minute droplets using the piezoelectric element, thereby reducing manufacturing costs, and which is capable of realizing one-time use of the ejection device.

2. Description of the Related Art

The field of bio-technology, among highly developed modern high technologies, has recently received a great deal of attention. In general, since many biological samples used in bio-technological research pertain to the human body, a micro-fluid system that may perform a transfer operation, a control operation, an analysis operation, and the like on minute fluid samples existing in a state of being inevitably dissolved in fluid or a fluid medium may be an essential element technology for the bio-technology.

The micro-fluid system may use Micro Electro Mechanical System (MEMS) technology, and has been utilized in fields using continuous intracorporeal injection of drugs or bioactive substances such as insulin or the like, a single-chip testing device (lab-on-a-chip), chemical analysis for new drug development, inkjet printing, a compact cooling system, a small fuel cell, and the like.

As an essential element for transferring fluid in the micro-fluid system, a micro-ejector, that is, a micro-ejecting device may be used. In particular, in the case of a micro-ejector used for transferring substances for medical biomaterials, since fluid having strong viscosity and exhibiting conductivity may need to be dealt with, due to properties of the biomaterials, a micro-ejector using a piezoelectric element may be mainly used.

As for the micro-ejector using the piezoelectric element, a connection line for applying power to the piezoelectric element from an external power source and a piping system supplying fluid such as fluid containing samples and the like, to an ejection device may need to be provided, which causes an increase in manufacturing costs, and therefore the ejection device may need to be cleansed and reused, resulting in an increase in a possibility of cross-contamination of the fluid such as fluid containing samples and the like, and a reduction in ejection-operational efficiency.

SUMMARY OF THE INVENTION

An aspect of the present invention provides a micro-ejector in which a power supplying line for a plurality of ejection devices and a piping system for supplying fluid may be integrally formed, thereby reducing manufacturing costs, and which is capable of realizing one-time use of the plurality of ejection devices.

According to an aspect of the present invention, there is provided a micro-ejector, including: an ejection device including a passage for ejecting fluid contained therein, and a piezoelectric actuator providing a driving force for ejecting fluid; a mounting plate including a passage for providing fluid to the ejection device formed therein, and a mounting groove on which the ejection device is mounted; and a connection member formed on the mounting plate, and adopted for connecting the piezoelectric actuator to an external power source.

The mounting plate may include a support plate on which the mounting groove is formed, and a passage plate including a passage for providing fluid to the ejection device formed therein, and the connection member.

Both the support plate and the passage plate may include a through hole into which a bolt is inserted, respectively, and may be coupled to each other by a joint between the bolt inserted into the through hole and a nut.

The micro-ejector may further include a tightening device adjusting a pressing force between the support plate and the passage plate.

The ejection device may be detachably mounted on the mounting groove.

The mounting plate may include an elastic member enabling the ejection device to be closely fitted to the mounting groove.

The mounting plate may include a thermoelectric element heating or cooling the fluid, and a cooling passage cooling the thermoelectric element.

An end of a fluid inflow hole side of the ejection device and an end of the mounting groove corresponding to the end of the fluid inflow hole side may be respectively formed to have a V-shape.

The mounting plate may include a fluid inlet, a fluid reservoir, and a fluid outlet, and the ejection device may include a fluid inflow hole being in close contact with the fluid outlet, a pressure chamber in which a pressure is changed by the driving force of the piezoelectric actuator, and a nozzle part ejecting the fluid from the pressure chamber.

A sealing member may be provided between the fluid outlet and the fluid inflow hole so that leakage of the fluid may be prevented when the fluid is transferred to the fluid inflow hole from the fluid outlet.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
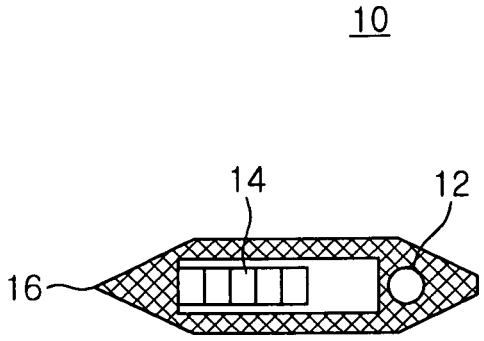
FIG. 1 is a view showing a configuration of an ejection device in a micro-ejector according to an exemplary embodiment of the present invention.

Exemplary embodiments of the present invention will now be described in detail with reference to the accompanying drawings. However, it should be noted that the spirit of the present invention is not limited to the embodiments set forth herein and those skilled in the art and understanding the present invention can easily accomplish retrogressive inventions or other embodiments included in the spirit of the present invention by the addition, modification, and removal of components within the same spirit, and those are to be construed as being included in the spirit of the present invention.

Further, throughout the drawings, the same or similar reference numerals will be used to designate the same components or like components having the same functions in the scope of the similar idea.

Figure 2A:
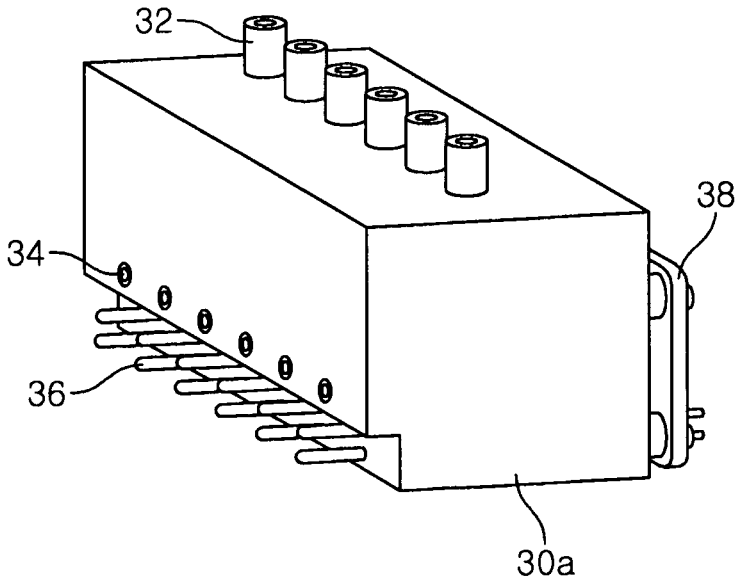
FIGS. 2A and 2B are views showing a structure of a micro-ejector according to an exemplary embodiment of the present invention.
Figure 2B:
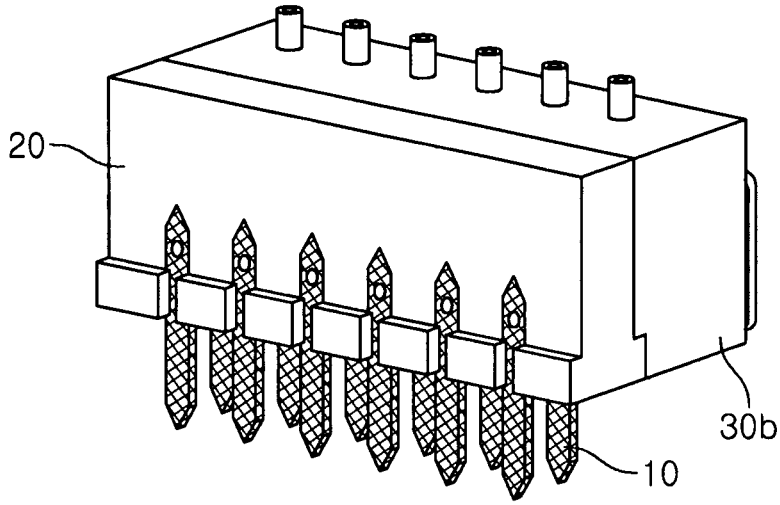
Figure 3:
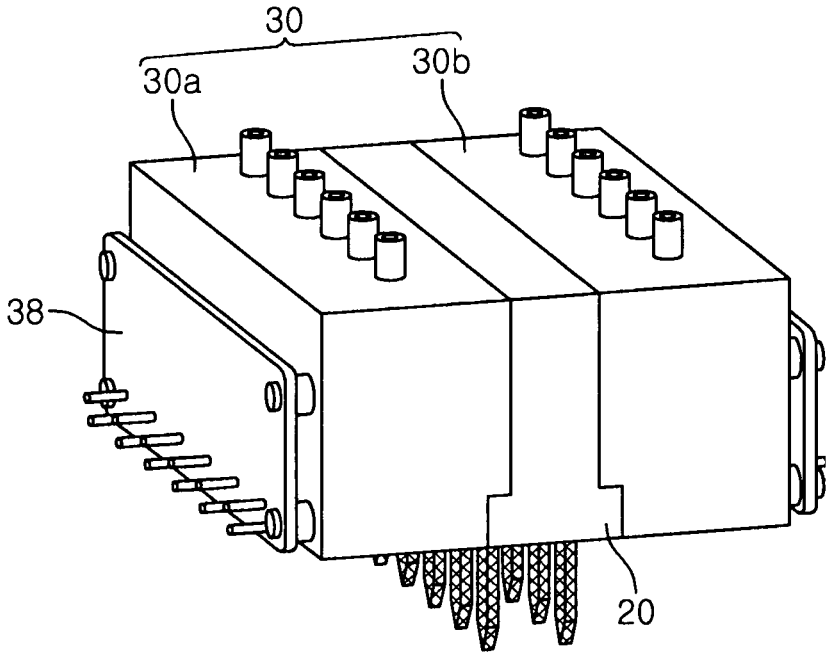
FIG. 3 is a perspective view showing a micro-ejector according to an exemplary embodiment of the present invention.
Figure 4:
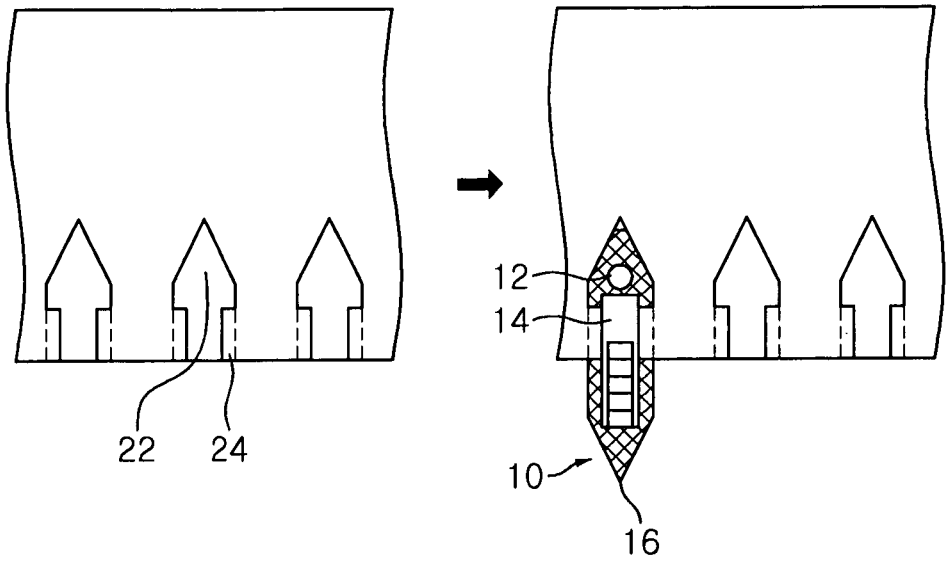
FIG. 4 is a view showing a structure on which an ejection device is mounted in a micro ejector according to an exemplary embodiment of the present invention.

FIG. 1 is a view showing a configuration of an ejection device in a micro-ejector according to an exemplary embodiment of the present invention, FIGS. 2A and 2B are views showing a structure of a micro-ejector according to an exemplary embodiment of the present invention, FIG. 3 is a perspective view showing a micro-ejector according to an exemplary embodiment of the present invention, and FIG. 4 is a view showing a structure on which an ejection device is mounted in a micro ejector according to an exemplary embodiment of the present invention.

First, referring to FIG. 1, a structure of the ejection device 10 according to an exemplary embodiment of the present invention may include a passage formed in an inner side of a substrate, a fluid inflow hole 12 through which fluid is supplied to the passage, a piezoelectric actuator 14 formed in a location corresponding to a pressure chamber (not shown) positioned within the passage in order to provide a driving force for fluid ejection to the pressure chamber, and a nozzle part 16 through which fluid is ejected in minute droplets.

The substrate constituting the ejection device 10 may be a single crystal silicon substrate or a Silicon on Insulator. (SOI) wafer in which an insulating layer is formed between two silicon layers. Here, at least one of the substrates may be used. Also, the passage may be formed by dry-etching or wet-etching the substrate.

The piezoelectric actuator 14 may be formed on an upper surface of the substrate to correspond to the pressure chamber, and may include a lower electrode acting as a common electrode, a piezoelectric film changed in accordance with applied voltage, and an upper electrode acting as a driving electrode.

The lower electrode may be formed on an entire surface of the substrate, and may be formed of a single conductive metal material, however, the lower electrode may be formed of two metal thin films consisting of titanium (Ti) and platinum (Pt). The lower electrode may act as a diffusion blocking layer for preventing mutual diffusion between the piezoelectric film and the substrate, as well as acting as the common electrode.

The piezoelectric film may be formed on the lower electrode, and disposed to be positioned above the pressure chamber. The piezoelectric film may be formed of piezoelectric substances, and may be formed of Lead Zirconate Titanate (PZT) ceramic materials. The upper electrode may be formed on the piezoelectric film, and may consist of at least one of a substance such as platinum (Pt), gold (Au), silver (Ag), nickel (Ni), titanium (Ti), copper (Cu), and the like.

Referring to FIGS. 2 through 4, the micro-ejector according to an exemplary embodiment of the present invention may include the ejection device 10, a support plate 20, and a passage plate 30.

The support plate 20 may include a mounting groove 22 in which the ejection device 10 is mounted. The mounting groove 22 may be formed to have a shape corresponding to the ejection device 10, and the ejection device 10 may be fixedly fitted into the mounting groove 22.

In this instance, a fixing part 24 may be formed in an upper portion of the mounting groove 22, and may fix the ejection device 10 to the mounting groove 22 while acting as a guide at the time of sliding coupling with the ejection device 10. That is, the ejection device 10 may slide from a lower portion of the support plate 20 towards an upper portion thereof, along the guide formed by the fixing part 24, to thereby be fixedly coupled with the mounting groove 22.

In order that the position of the nozzle part is always the same when inserting the ejection device 10 into the mounting groove 22, an end of a side of the ejection device 10 in which the fluid inflow hole 12 is formed and an end of the mounting groove 22 corresponding to the end of the fluid inflow hole side of the ejection device 10 may be respectively formed to have a V-shape.

The ejection device 10 may be detachably mounted in the mounting groove 22. That is, the ejection device 10 fixedly fitted into or slidably coupled with the mounting groove 22 may be separated from the mounting groove 22. Specifically, the ejection device 10 may be pulled or slidably moved in a direction opposite to a coupling direction to thereby be separated from the mounting groove 22.

As shown in FIGS. 2 and 3, since a plurality of ejection devices 10 may be arranged in two columns, the passage plate 30 may include a first passage plate 30*a* coupled to a set of the ejection devices arranged in a first column, and a second passage plate 30*b* coupled to a set of the ejection devices arranged in a second column.

The passage plate 30 may include a fluid inlet 32 through which fluid flows inwardly, a fluid reservoir (not shown) storing the fluid inflowing in the fluid inlet 32, and a fluid outlet 34 through which fluid is supplied to each of the plurality of ejection devices 10. In this instance, a sealing member may be formed on the fluid outlet 34 so that fluid leakage is prevented when the fluid is moved to the fluid inflow hole 12 of the ejection device 10 from the fluid outlet 34.

The passage plate 30 may be coupled with the support plate 20 to which the ejection device 10 is coupled so that the ejection device 10 may be fixed, and may be detachably coupled from the support plate 20 at the time of replacement of the ejection device 10.

A connection member 36 may be formed on a portion of the passage plate 30 corresponding to the piezoelectric actuator 14 of the ejection device 10, and may apply power to the piezoelectric actuator 14 from an external power source.

The connection member 36 may be formed of pins for electrical connection, and a single ejection device may include a plurality of pins.

The passage plate 30 may include a substrate 38 for applying power formed on a side thereof, and a through hole may be formed in the substrate 38 for applying power. The connection member 36 may be inserted into the through hole, and slidably moved through the through hole when the support plate 20 and the passage plate 30 are coupled to each other. Accordingly, a dimensional error of the connection member 36 may be corrected when fabricating the passage plate 30.

According to the present exemplary embodiment, the support plate 20 on which the ejection device 10 is mounted and the passage plate 30, providing fluid to the ejection device 10, are illustrated; however, the present invention is not limited thereto. Thus, a single plate may be used, or the connection member 36 may be formed on the support plate 20, which will be changed in various manners, according to required conditions and design specifications.

Figure 5:
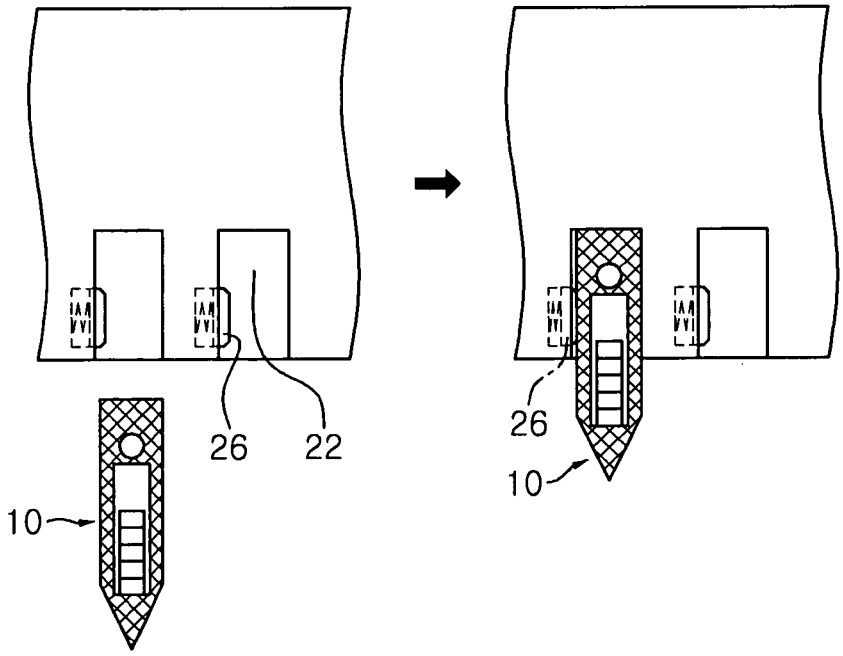
FIG. 5 is a view showing a structure on which an ejection device is mounted in a micro ejector according to another exemplary embodiment of the present invention.

FIG. 5 is a view showing a structure on which an ejection device is mounted in a micro-ejector according to another exemplary embodiment of the present invention.

The micro-ejector of FIG. 5 according to another exemplary embodiment of the present invention may include an elastic member formed on a side of the mounting groove so as to enable the ejection device to be fixedly mounted and to obtain positional accuracy of the ejection device. Here, configurations other than the above described configuration of the micro-ejector according to another exemplary embodiment may be the same as those of the micro-ejector according to an exemplary embodiment shown in FIGS. 1 through 4. Thus, detailed descriptions thereof will be omitted, and only differences therebetween will hereinafter be described.

Referring to FIG. 5, the micro-ejector according to another exemplary embodiment may include the elastic member 26 formed on the side of the mounting groove 22. The elastic member 26 may be protrusively formed on a side wall of the mounting groove 22, and enable the ejection device 10 to be closely fitted to the mounting groove 22 in the case that the ejection device 10 is mounted on the mounting groove 22. Accordingly, a position of the nozzle part of the ejection device 10 may be fixedly maintained.

As for an operation of the elastic member 26 when the ejection device 10 is mounted on the mounting groove 22, the elastic member 26 may be protruded from the side wall of the mounting groove 22 when the ejection device 10 is not mounted on the mounting groove 22, and may be compressed by the ejection device 10 when the ejection device 10 is inserted or pushed into the mounting groove 22 while sliding along the side wall of the mounting groove 22, so that the ejection device 10 may be closely fitted to another side wall opposite to the side wall of the mounting groove 22, by a restoring force of the elastic member 26. Accordingly, a gap between the mounting groove 22 and the ejection device 10 may be created by a difference between a width of the mounting groove 22 and a width of the ejection device 10, and the elastic member 26 may be protruded by the difference.

According to the present exemplary embodiment, the elastic member 26 that is formed on the side wall of the mounting groove 22 is illustrated; however, the present invention is not limited thereto. Thus, the elastic member 26 may be formed on both side walls of the mounting groove 22, or be formed on a bottom surface of the mounting groove 22.

In the case where the elastic member 26 is formed on the bottom surface of the mounting groove 22, a difference between a height of the mounting groove 22 and a thickness of the ejection device 10 may be corrected and thus, a joint between the fluid inflow hole of the ejection device 10 and the fluid outlet of the passage plate may be secured, and an electrical connection between the piezoelectric actuator and the connection member may be secured.

Meanwhile, another structure of the micro-ejector may be adopted so as to improve the positional accuracy of the ejection device 10. For example, an elastic protrusion formed on a bottom surface of the mounting groove 22 and a groove portion formed on a lower surface of the ejection device 10 may be provided so that the elastic protrusion may be elastically coupled to the groove portion. Otherwise, the structure of the micro-ejector may be changed in various manners, according to required conditions and design specifications.

Figure 6:
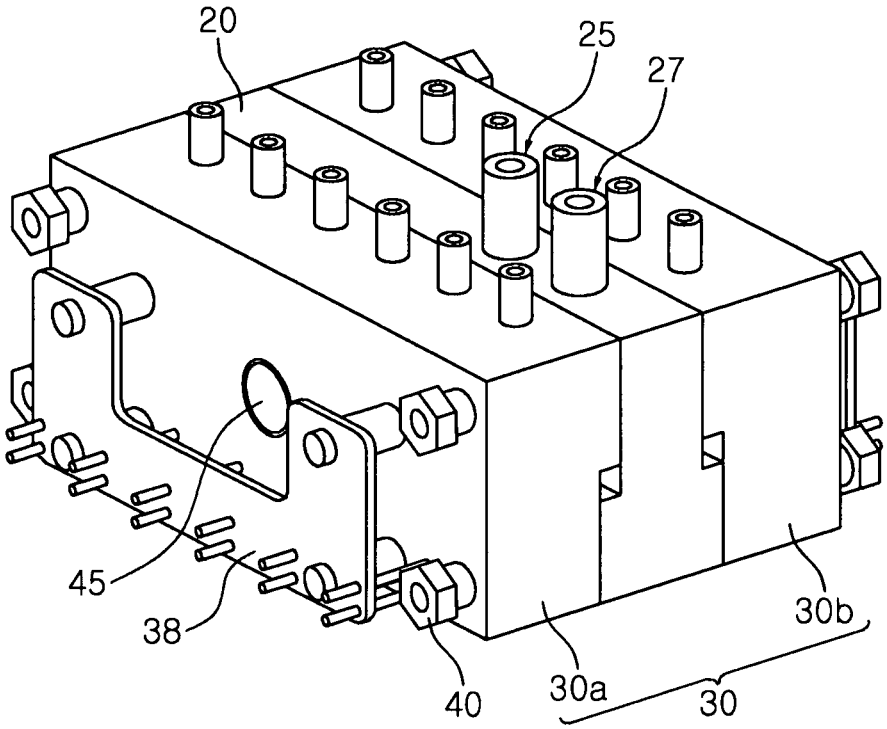
FIG. 6 is a perspective view showing a micro-ejector according to another exemplary embodiment of the present invention.

FIG. 6 is a perspective view showing a micro-ejector according to another exemplary embodiment of the present invention.

In the micro-ejector of FIG. 6 according to another exemplary embodiment of the present invention, the support plate and the passage plate may be coupled to each other in a screw-coupling manner, a tightening device adjusting a pressing force between the support plate and the passage plate may be further provided, and a mechanism for adjusting a temperature of fluid may be formed on the support plate. Here, configurations other than the above described configuration of the micro-ejector according to another exemplary embodiment may be the same as those of the micro-ejector according to an exemplary embodiment shown in FIGS. 1 through 4. Thus, detailed descriptions thereof will be omitted, and only differences therebetween will hereinafter be described.

Referring to FIG. 6, as for the micro-ejector according to another exemplary embodiment of the present invention, both the support plate 20 and the passage plate 30 may include a through hole into which a bolt is inserted, respectively, and may be coupled to each other by a joint between the bolt 40 inserted into the through hole and a nut. Also, the micro-ejector may further include a tightening device 45 adjusting a pressing force between the support plate 20 and the passage plate 30. The tightening device 45 may be formed to have a screw-shape, and the pressing force between the support plate 20 and the passage plate 30 may be increased as the tightening device 45 is tightly screwed, and the pressing force may be reduced as the tightening device 45 is loosened in a direction opposite to that in which the tightening device 45 is tightly screwed.

In addition, both a thermoelectric element (not shown) for heating or cooling fluid ejected by the ejection device and a cooling passage (not shown) for cooling the thermoelectric element may be formed in an inner side of the support plate 20 where the ejection device 10 is mounted, respectively. Cooling fluid for cooling the thermoelectric element may flow through a fluid inlet 25, may cool the thermoelectric element while being moved along the cooling passage formed in the vicinity of the thermoelectric element, and may then be discharged through a fluid outlet 27.

As set forth above, according to exemplary embodiments of the present invention, there is provided a micro-ejector in which a power supplying line for the plurality of ejection devices and a piping system for supplying fluid may be integrally formed, thereby reducing manufacturing costs, and which is capable of realizing one-time use of the plurality of ejection devices, resulting in the preventing of cross-contamination of the fluid due to a reuse of the ejection device. For example, according to exemplary embodiments of the present invention, the configuration of the passage formed in the inner side of the ejection device may be merely an example and thus, other required configurations may be further provided. In addition, in order to form the passage, a chemical or mechanical fabrication scheme other than an etching scheme may be adopted.

While the present invention has been shown and described in connection with the exemplary embodiments, it will be apparent to those skilled in the art that modifications and variations can be made without departing from the spirit and scope of the invention as defined by the appended claims.

What is claimed is:

1. A micro-ejector, comprising:

an ejection device including a passage for ejecting fluid contained therein, and a piezoelectric actuator providing a driving force for ejecting fluid;

a mounting plate including a passage for providing fluid to the ejection device formed therein, a mounting groove on which the ejection device is mounted, and an elastic member formed on one side wall of the mounting groove and enabling the ejection device to be closely fitted to the mounting groove, the elastic member protruding against the ejection device to thereby push the ejection device toward another side wall of the mounting groove; and a connection member formed on the mounting plate, and adopted for connecting the piezoelectric actuator to an external power source, the ejection device being removable from the mounting groove, and the connection member being selectively connected to or disconnected from the piezoelectric actuator depending on whether the ejection device is mounted on or removed from the mounting groove.

2. The micro-ejector of claim 1, wherein the mounting plate includes:

a support plate on which the mounting groove is formed, and a passage plate including a passage for providing fluid to the ejection device formed therein, and the connection member.

3. The micro-ejector of claim 2, wherein both the support plate and the passage plate include a through hole into which a bolt is inserted, respectively, and are coupled to each other by a joint between the bolt inserted into the through hole and a nut.

4. The micro-ejector of claim 2, further comprising a tightening device adjusting a pressing force between the support plate and the passage plate.

5. The micro-ejector of claim 1, wherein an end of a fluid inflow hole side of the ejection device and an end of the mounting groove corresponding to the end of the fluid inflow hole side are respectively formed to have a V-shape.

6. The micro-ejector of claim 1, wherein the mounting plate includes a fluid inlet, a fluid reservoir, and a fluid outlet, and the ejection device includes a fluid inflow hole being in close contact with the fluid outlet, a pressure chamber in which a pressure is changed by the driving force of the piezoelectric actuator, and a nozzle part ejecting the fluid from the pressure chamber.

7. The micro-ejector of claim 6, wherein a sealing member is provided between the fluid outlet and the fluid inflow hole so that fluid leakage is prevented when the fluid is transferred to the fluid inflow hole from the fluid outlet.

8. A micro-ejector, comprising:

a mounting plate including a plurality of passages to provide fluid, and a plurality of mounting grooves, a plurality of ejection devices respectively mounted on the plurality of mounting grooves and respectively provided with fluid by the plurality of passages, each of the plurality of ejection devices being removable from the respective mounting groove, including a passage to eject fluid contained therein, including a piezoelectric actuator providing a driving force to eject fluid, and having a longitudinal end that is outside of the mounting plate and is protruding out of and away from the mounting plate; and a connection member formed on the mounting plate, and adopted to connect the piezoelectric actuators to an external power source, the mounting plate including a plurality of elastic members, each formed on one side wall of a respective mounting groove of the plurality of mounting grooves, each enabling the respective ejection device to be closely fitted to the respective mounting groove, and each protruding against the respective election device to thereby push the respective election device toward another side wall of the respective mounting groove.

* * * * *

UNITED STATES PATENT AND TRADEMARK OFFICE

CERTIFICATE OF CORRECTION

PATENT NO. : 8,870,356 B2
APPLICATION NO. : 12/926625
DATED : October 28, 2014
INVENTOR(S) : Sang Jin Kim et al.

It is certified that error appears in the above-identified patent and that said Letters Patent is hereby corrected as shown below:

On the Title Page, Item [75] (Inventors), Column 1, Line 1, Delete "Gyunggi-do" and insert -- Suwon --, therefor.

On the Title Page, Item [75] (Inventors), Column 1, Line 2, Delete "Gyunggi-do" and insert -- Yongin --, therefor.

On the Title Page, Item [75] (Inventors), Column 1, Line 3, Delete "Gyunggi-do" and insert -- Ansan --, therefor.

In the Claims

Column 8, Line 34, In Claim 8, delete "election" and insert -- ejection --, therefor.

Column 8, Line 35, In Claim 8, delete "election" and insert -- ejection --, therefor.

Signed and Sealed this
Thirty-first Day of March, 2015

Michelle K. Lee

Michelle K. Lee
*Director of the United States Patent and Trademark Office*